US005248051A

United States Patent [19]

Yurgevich et al.

[11] Patent Number: 5,248,051

[45] Date of Patent: Sep. 28, 1993

[54] LARGER CUBIC VOLUME CARGO CONTAINER

[75] Inventors: Howard J. Yurgevich; Thomas J. Rosby, both of Monticello, Ind.

[73] Assignee: Rosby Corporation, Monon, Ind.

[21] Appl. No.: 17,786

[22] Filed: Feb. 16, 1993

Related U.S. Application Data

[63] Continuation of Ser. No. 839,811, Feb. 21, 1992, Pat. No. 5,205,428.

[51] Int. Cl.[5] ..... B65D 19/04

[52] U.S. Cl. ..... 220/1.5; 108/51.1; 206/599

[58] Field of Search ..... 220/1.5, 6.2, 627; 206/599; 108/51.1, 901

[56] References Cited

U.S. PATENT DOCUMENTS

| | | | |
|---|---|---|---|
| 3,995,749 | 12/1976 | Haskins | 206/599 |
| 4,413,737 | 11/1983 | Wind | 206/599 |
| 4,750,633 | 6/1988 | Schafer | 206/599 |
| 4,790,249 | 12/1988 | Webb | 108/51.3 |
| 4,809,851 | 3/1989 | Oestreich, Jr. et al. | 206/599 |
| 4,982,860 | 1/1991 | Dinsmoor et al. | 206/599 |
| 5,058,747 | 10/1991 | Decroix et al. | 206/599 |

*Primary Examiner*—Joseph Man-Fu Moy
*Attorney, Agent, or Firm*—Locke Reynolds

[57] ABSTRACT

A cargo container generally includes a floor, a roof, a pair of parallel side walls, and first and second end walls, at least one of the side walls and end walls including an opening to permit the entry and exit of cargo from the enclosed space. The floor is formed to include a a plurality of low profile support elements extending transversely between the side walls. The plurality of support elements are uniformly distributed thoughout the entire length of floor, with each support element consisting essentially of a pair of uniformily spaced apart vertical members having upper and lower ends, a horizontal member joining the lower ends of the vertical members to form in cross section a U-shape, a reinforcing strap contiguously welded to the horizontal member, and outwardly extending flanges from the tops of each of the vertical members. The floor surface is coupled to the support element flanges.

15 Claims, 7 Drawing Sheets

LARGER CUBIC VOLUME CARGO CONTAINER

This application is a continuation application of Ser. No. 07/839,811 filed on Feb. 21, 1992 now U.S. Pat. No. 5,205,428.

BACKGROUND OF THE INVENTION

The present invention relates to cargo carrying containers suitable for use in multi-mode transportation of freight or cargo by ship, rail, or overland trucking. Examples of cargo containers are found in Harlander, et al., U.S. Pat. No. 3,034,825, Tantlinger, U.S. Pat. No. 3,085,707, Bodenheimer, U.S. Pat. No. 3,646,609, and Schmidt, U.S. Pat. No. 4,212,405.

Many cargo containers suitable for multi-mode transport of cargo have recognized standard dimensions, structural features that minimize handling problems, and allow for stacking of containers. However, there exist a number of different and changeable standards. For example, in recent years, due to the relaxation of the permitted width dimension allowed on over-the-road truck trailers, some attention has been directed to the construction of an increased width containers to increase container capacity as disclosed in Yurgevich, U.S. Pat. No. 4,844,672.

Another possible way for increasing the container capacity while retaining the outside maximum dimensions standardized by the industry regulations is by increasing the vertical height dimension of the interior of the cargo container. For example, the vertical height of conventional I-beam floor supports, as well as the thickness of wood flooring attached to the floor supports, can be reduced to increase the cargo carrying capacity of the container. However, the structural requirements for supporting cargo containers do not reasonably permit substantial decrease in floor thickness using such conventional materials or structures.

Accordingly, an object of the present invention is provision of a container having substantially increased usable internal space through utilization of a novel floor structure having minimum vertical dimensions while retaining the strength necessary to permit stacking of the container and contents in the conventional manner. Another object of the present invention is the use of such a novel floor structure in a container having other volume maximizing features to achieve a very large cubic volume container particularly suitable for the containerized freight market.

SUMMARY OF THE INVENTION

A cargo container for carrying cargo within an enclosed compartment in accordance with the present invention is defined generally by a floor, a roof, a pair of parallel side walls, and first and second end walls. At least one of the side or end walls includes an opening therethrough to permit entry and exit of cargo. The interior of the cargo container is maximized in the vertical direction by incorporating a floor comprising a plurality of low profile floor supports extending between the side walls. The plurality of floor supports are substantially uniformly distributed throughout the entire length of the floor, with each floor support consisting essentially of a pair of uniformly spaced apart vertical members having upper and lower ends. The horizontal member joins the lower ends of the two vertical members to form in cross-section a U-shape. Reinforcing bars are provided for reinforcing the horizontal member joining the lower ends forming the bight of the U-shape. Flanges extend outwardly from the tops of each of the vertical members. The floor surface is defined by a plurality of hardwood strips. Typically, these strips are attached by screws, bolts, or other conventional fasteners to flanges extending outward from the upper end of the vertical members. The length of the vertical members is defined to be less than the horizontal distance between the vertical members of each support element, permitting the floor to occupy a minimum vertical space and increasing the internal capacity of the cargo container as compared to cargo containers having floors supported by conventional I-beams.

In a preferred embodiment, the width dimension of the container is also maximized by employing a side wall structure which consists essentially of a plurality of alumimum alloy plates assembled side-by-side with the lower edge of each plate overlying and joined to a base rail coupled to the end joining means of the floor support elements. A plurality of rectilinear aluminum strips overlap and join adjacent sides of the aluminum plates to seal the enclosed compartment against the outside environment.

One feature of the present invention is the use in the floor of a container of a plurality of low profile floor supports as described. The vertical dimension of such floor supports is minimized to permit the floor to occupy a minimum vertical space, thereby maximizing the internal volume capacity of the cargo carrier enclosed compartment.

Other features and advantages of the invention will become apparent to those skilled in the art upon consideration of the following detailed description of a preferred embodiment exemplifying the best mode of carrying out the invention as presently perceived. The detailed description particularly refers to the accompanying figures.

DETAILED DESCRIPTION OF THE INVENTION

Figure 1:
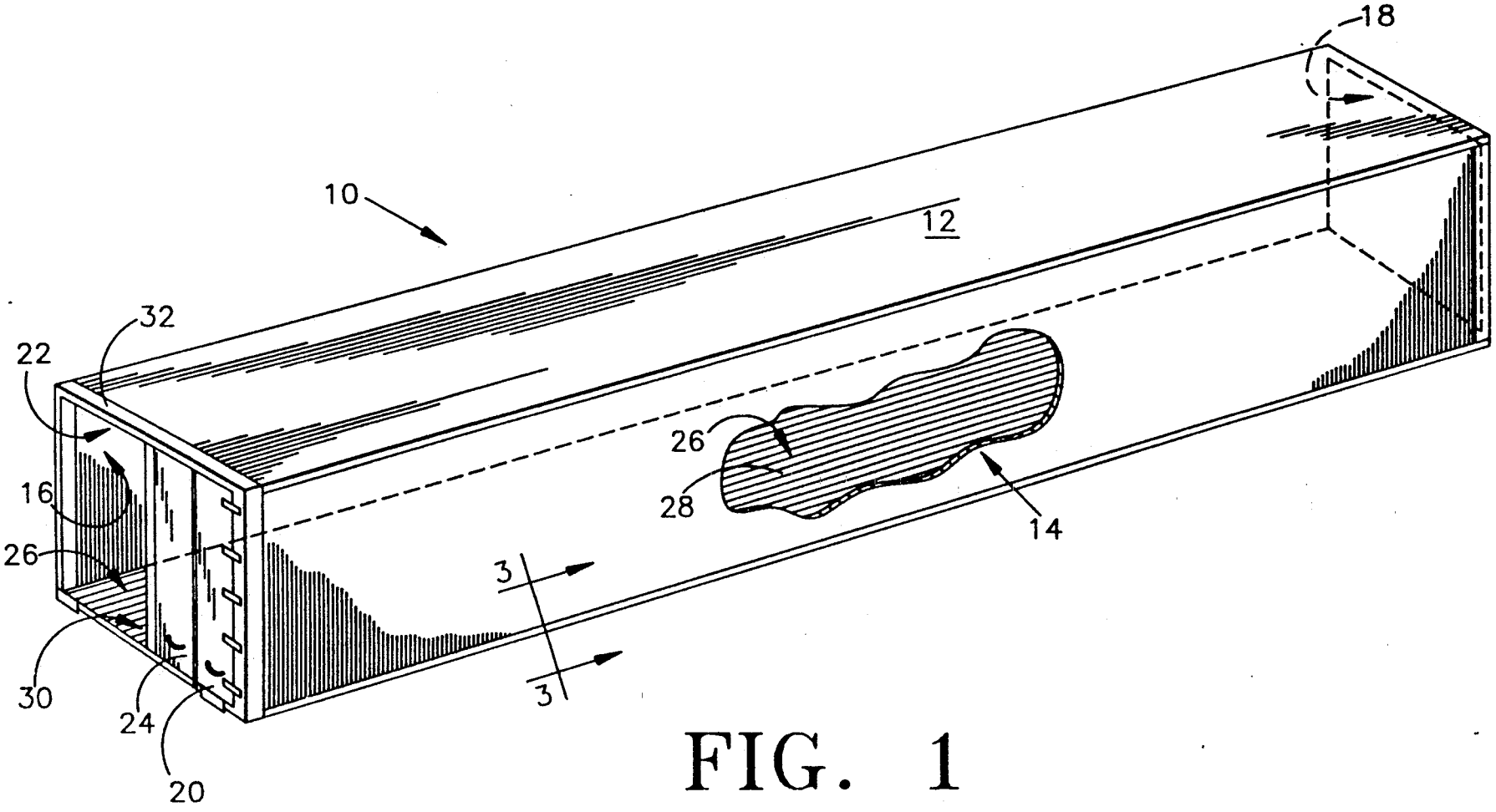
FIG. 1 is a perspective schematic view of a standardized dimension cargo container, having a sidewall partially broken away to better illustrate a low vertical profile floor in accordance with the Present invention.
Figure 2:
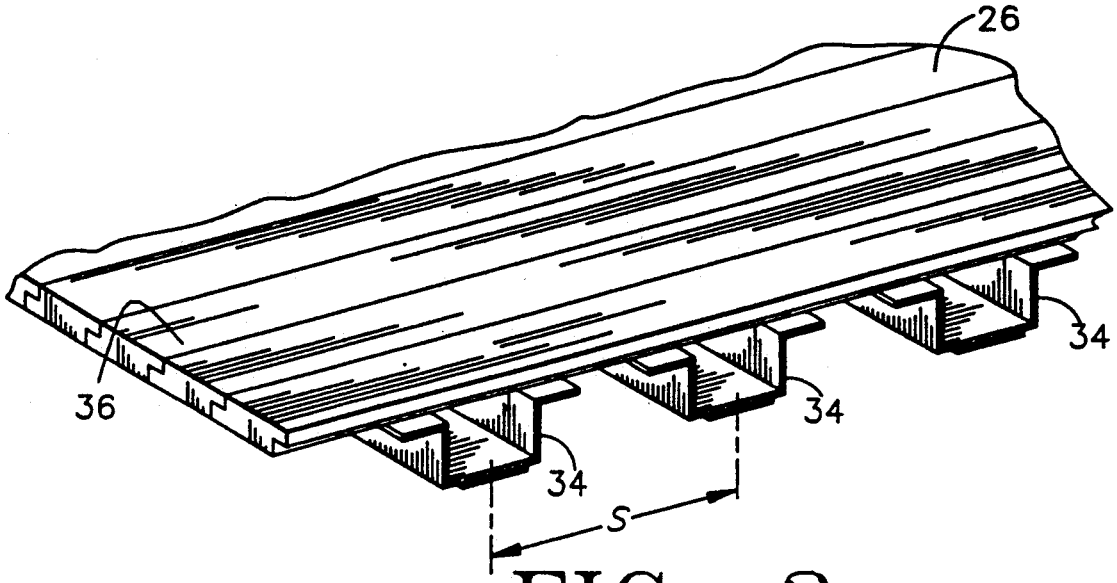
FIG. 2 is a perspective view of the floor structure of such a cargo container partially broken away to show several U-shaped low profile floor supports.

A high cubic volume cargo container 10 in accordance with the present invention is shown in FIG. 1 to comprise a roof 12, side walls 14 and 16, a closed front end 18 and a rear end 20 including an opening 22 closable by a pair of doors 24, and a floor 26. In order to achieve a thin, low vertical height floor structure that maximizes internal volume of the cargo container 10, the floor 26 is constructed as schematically shown in FIG. 2 to comprise a plurality of spaced apart low profile floor supports 34 which extend transversely between the side walls 14 and 16. The low profile floor supports 34 are substantially uniformly distributed along the entire floor 26 at a regular spacing. Typically the floor supports 34 are spaced apart between 6 inches to 15 inches, although greater or lesser spacing can be used depending upon contemplated weight carrying capacity of the cargo container. In one preferred embodiment, the floor supports are spaced about 8 inches apart.

A floor surface 28 supported by the floor supports 34 is defined in part by strips 36 and metal plates 30. The strips 36 typically comprise $\frac{7}{8}$ inch thick interlocking hardwood strips running lengthwise (perpendicular to the floor supports 34) within the cargo container 10. The metal plate 30 is a thin steel or aluminum sheeting that slopes slightly downward from its adjacent contact with the strips 36 toward the opening 22. Of course, the floor surface can be configured to be formed completely from hardwood strips, metal strips, metal plates, other conventional floor materials, or any combination of floor materials. In desired embodiments such as illustrated in the FIGS., the floor surface 28 presents a substantially flat (being slightly sloped downward toward the opening for a portion of its length) surface that eases sliding movement of cargo, and presents no impediments to block cargo loading.

Figure 3:
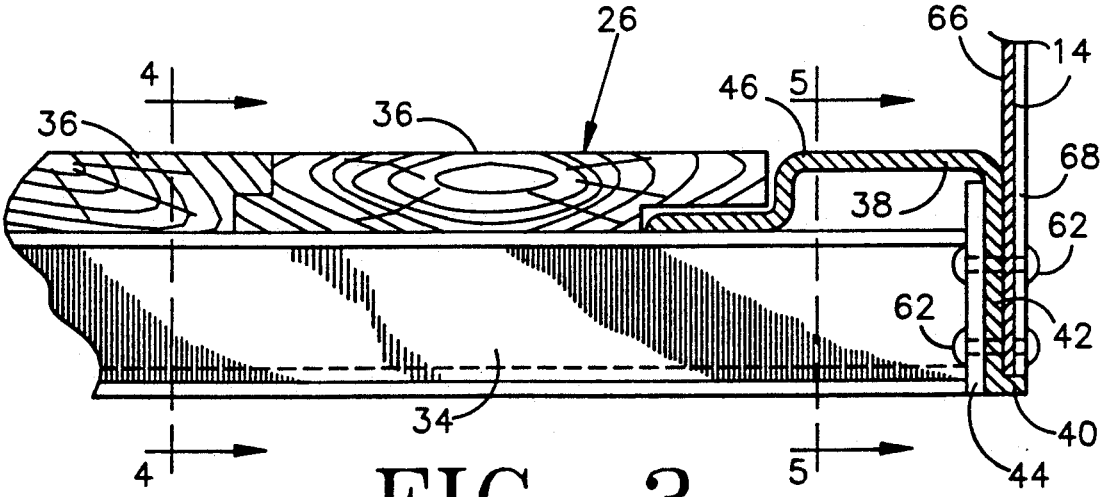
FIG. 3 is a sectional detail view of the floor and side wall of the present container taken along section line 3—3 of FIG. 1 to show attachment of the low profile floor supports to a side wall.

To position the floor supports 34 in fixed attachment relative to each other, each of the side walls 14, 16 includes a longitudinally extending base rail that defines the lateral outer margins of the floor surface3 28. As shown in FIG. 3, a base rail 38 is attached to side wall 14. The base rail 38 has a lower outside flange 40 defining the lower margin of the side wall 14. A lower vertical portion 42 includes an inside surface confronting and joining end joining means 44 described in greater detail in connection with FIG. 5. An upper portion 46 of side rail 38 comprises an inwardly directed flange which defines the outer margins of the upper surface of floor 26.

Figure 4:
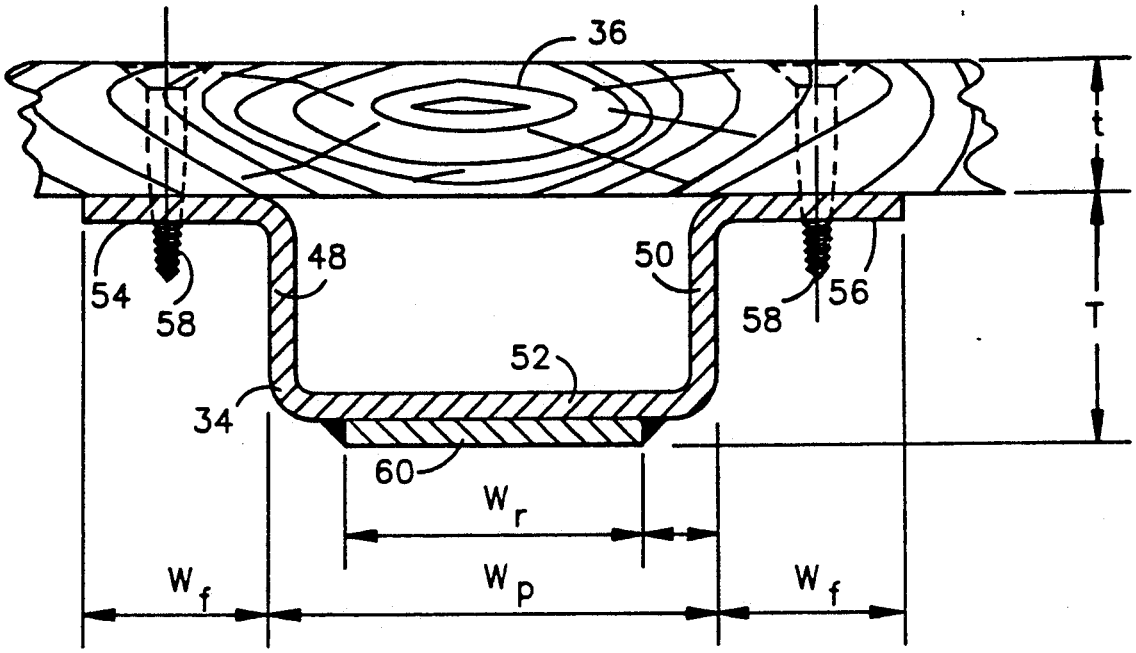
FIG. 4 is a sectional view taken along line 4—4 of FIG. 3 to illustrate a U-shaped low profile floor support having spaced apart vertical members attached to each other by a horizontally extending horizontal member, and with horizontally extending flanges extending outward from attachment to an upper end of the vertical members, the flanges being attached by bolts to a hardwood flooring strip.
Figure 5:
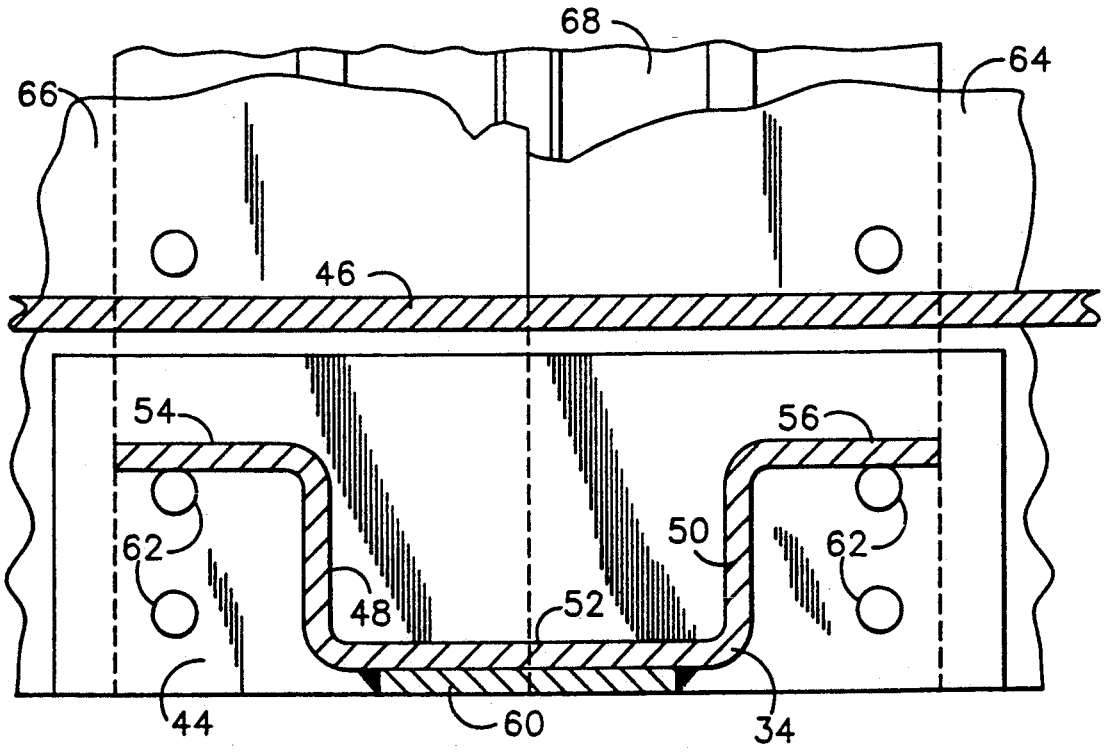
FIG. 5 is a sectional view taken along line 5—5 of FIG. 3 to show attachment of the floor support to the side wall.

The low profile floor supports are shown in greater detail in cross-section in FIGS. 4 and 5 to comprise a pair of uniformly spaced apart vertical portions 48 and 50. A horizontal member 52 unitarily joins the vertical portions 48 and 50 to form in cross-section a very broad, shallow U-shape. Flanges 54 and 56 extend outwardly from the tops of each of the vertical elements 48 and 50, the flanges being periodically penetrated by fastening means 58 fastening the floor defining members 36 through the tops of flanges 54 and 56. A reinforcing means 60 is welded to the horizontal portion 52 over substantially its entire length to provide the necessary strengthening means. The thickness "t" of the floor surface defining wood 36 is typically $\frac{7}{8}$ inch while the thickness "T" of the low profile support elements 34 are less than or equal to about $1\frac{7}{8}$ inch. The width "$W_r$" of the reinforcing portion 60 is typically about 2 inches while the distance "$W_p$" between the vertical portions 48 and 50 is approximately 3 inches. The width of the flanges "$W_f$" is preferably about $1\frac{1}{4}$ inches. The preferred material for the formation of the low profile support elements is 7 gauge (0.171 inch) high-tensile steel.

Of course, as those skilled in the art will appreciate, the reinforcing means 60 does not have to be separately formed and rigidly attached to the horizontal member 52. In other possible embodiments, the low profile floor supports 34 can be integrally formed as a single extruded piece, with the horizontal member 52 appropriately thickened relative to vertical portions 48 and 50 to increase its strength and rigidity.

The end joining means 44 are welded to the ends of the low profile support elements 34 and are shown in FIGS. 3 and 5 to extend above the flanges 54 and 56. Each end joining means 44 is coupled to the base rail 38 by fasteners 62 which penetrate the support elements 44, the base rail 38, aluminum alloy plates 64 and 66 collectively forming the sides 14 or 16, and the aluminum joining panel 68. The aluminum joining panel 68 is preferably of the type shown and described in Yurgevich, et al., U.S. Pat. No. 5,066,066 which is hereby incorporated by reference.

By utilizing a floor structure in accordance with the present invention, it is possible to achieve an interior vertical dimension at the door opening and throughout the interior of the container of 110 inches. By using the thin side wall structure of joined aluminum plates, the interior width dimension can approach or equal 101 inches. In certain preferred embodiments, the overall length of the container can approach 53 feet, thereby defining a substantially obstruction-free volume of exceptionally high cubic volume capacity for a container.

Figure 6:
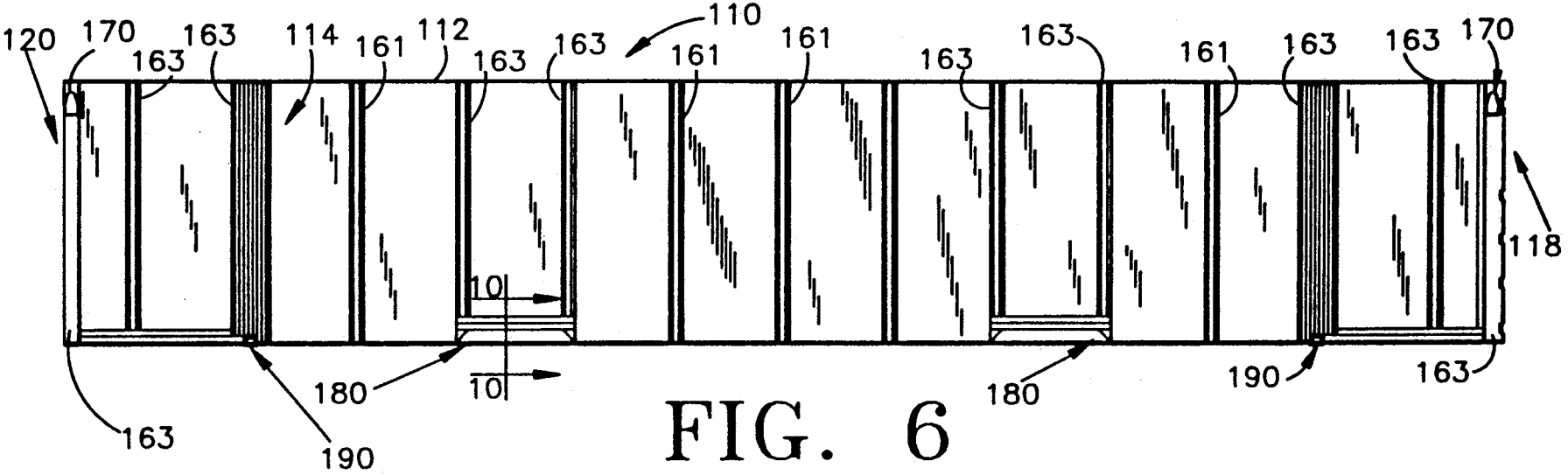
FIG. 6 is a side of view of a preferred embodiment of a cargo container similar to that shown in FIG. 1, the illustrated cargo container being constructed to have several alternative lifting points to permit easy movement and stacking of the cargo container atop other cargo containers.
Figure 7:
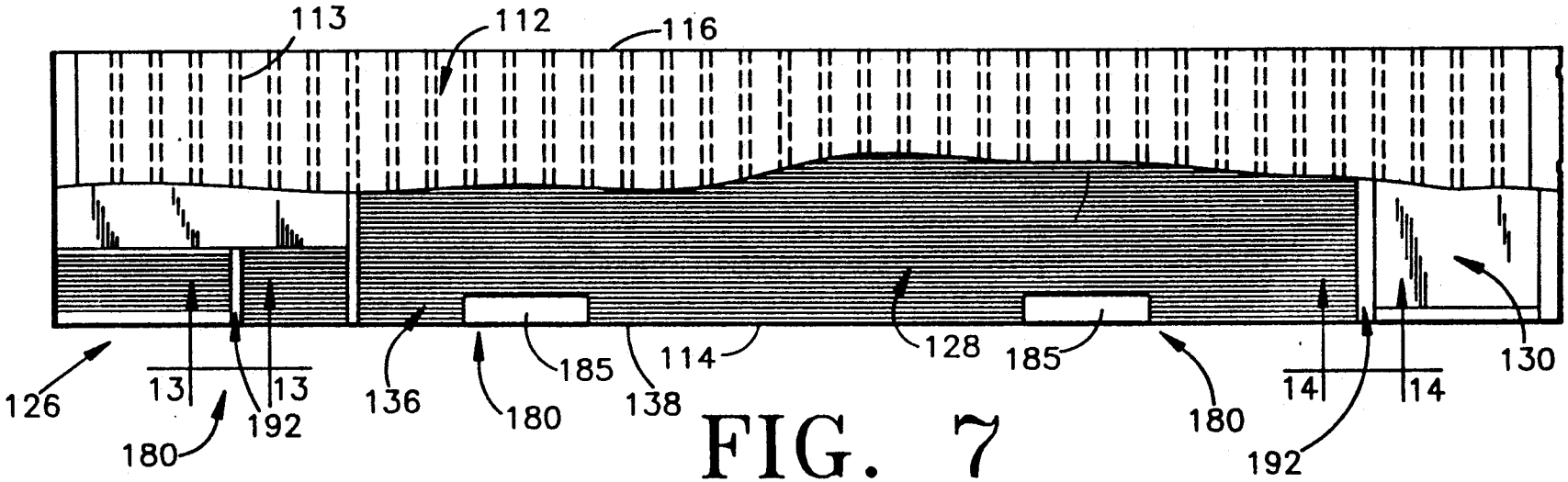
FIG. 7 is a top plan view of the roof of the cargo container illustrated in FIG. 6, the roof and roof supporting being partially removed to illustrate the low vertical profile floor.

A cargo container 110 is illustrated by FIGS. 6 and 7. The cargo container 110 is substantially similar to that illustrated by FIG. 1 and previously described. The cargo container 110, like the container 10, has a roof 112, sidewalls 114 and 116, a closed front end 118, and a rear end 120. The side walls 114 and 116 are supported by a provision of a number of aluminum stiffeners 161 and steel stiffeners 163 that are substantially uniformly spaced apart and distributed along the side walls of the container 110 typically positioned over abutted or overlapped joints of the adjacent plates forming the side walls. Steel stiffeners are utilized in those sections of the cargo container 110 expected to withstand the most tensional, compressional, or torque forces, while lighter weight aluminum stiffeners can be used in other, lighter duty sections of the container 110.

A top plan view of a roof 112, partially broken away to better illustrate floor structure of the cargo container 110 is illustrated by FIG. 7. A floor 126 of the cargo container 110 includes a plurality of floor strips 136 and a metal plate 130, providing a floor surface 128 to rest cargo upon. The floor strips 136 and metal plate 130 are connected to low profile floor supports 134. The low profile floor supports 134 are substantially similar in form and function to the low profile floor supports 34 previously described.

Transport of cargo containers having low profile floor supports in accordance with the present invention can be facilitated by provision of various lift attachment devices. For example, as illustrated generally in FIG. 6, the cargo container 110 is provided with top lift pockets 170, with bottom lift pockets 180, and with bottom lift pockets 190. Each of the lift pockets 170, 180, and 190 are provided in sets of four pockets. The pockets can be positioned bilaterally symmetric with respect to each other, with two pockets on one side being matched by correspondingly positioned pockets on the opposite side wall. In addition, pairs of pockets are typically positioned equivalent distances from the center of mass of the cargo container 110 to reduce problems with differential forces applied to lifting mechanisms hooked into the lift pockets to move the cargo container 110.

Figure 8:
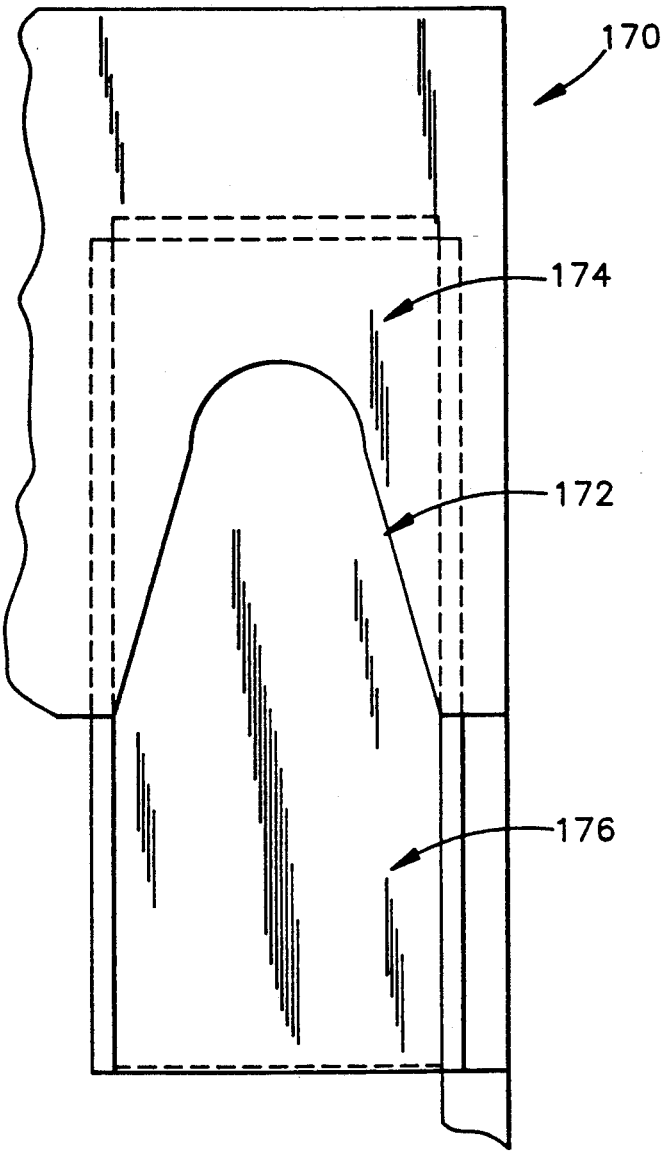
FIG. 8 is a detailed view of one of four identically configured top lift pockets designed to allow engagement of the cargo container for lifting or movement.
Figure 9:
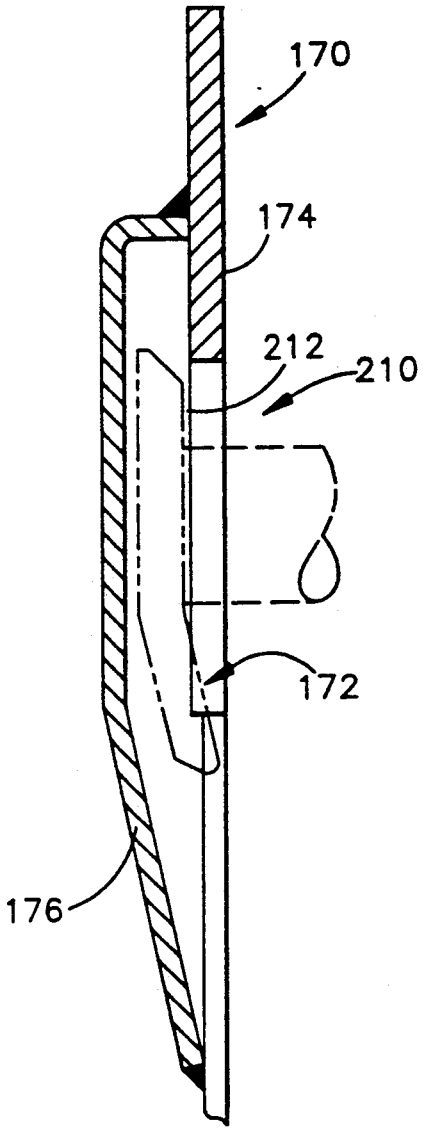
FIG. 9 is a side cross sectional view of a lift pocket such as shown in FIG. 8, with a lift shoe and lift bolt for engaging the top lift pocket schematically represented by the dotted outline.

The top lift pocket 170 is shown in more detail by FIGS. 8 and 9. As shown in those figures, the top lift pocket 170 is formed by the combination of a back plate 176 and a guide plate 174 formed to define a guide plate aperture 172. The top lift pocket 170 is dimensioned to accommodate insertion of a lift shoe 212, connected to a lift bolt 210. The lift bolt 210 can be connected to a crane, spreader, mover or some other device capable of lifting the container 110. As will be appreciated by those skilled in the art, it is not necessary to use four lift pockets 170 located at the corners of the cargo container 110. Instead, alternate positions of lift pockets are contemplated, as well as differing numbers of lift pockets, as needed.

Figure 10:
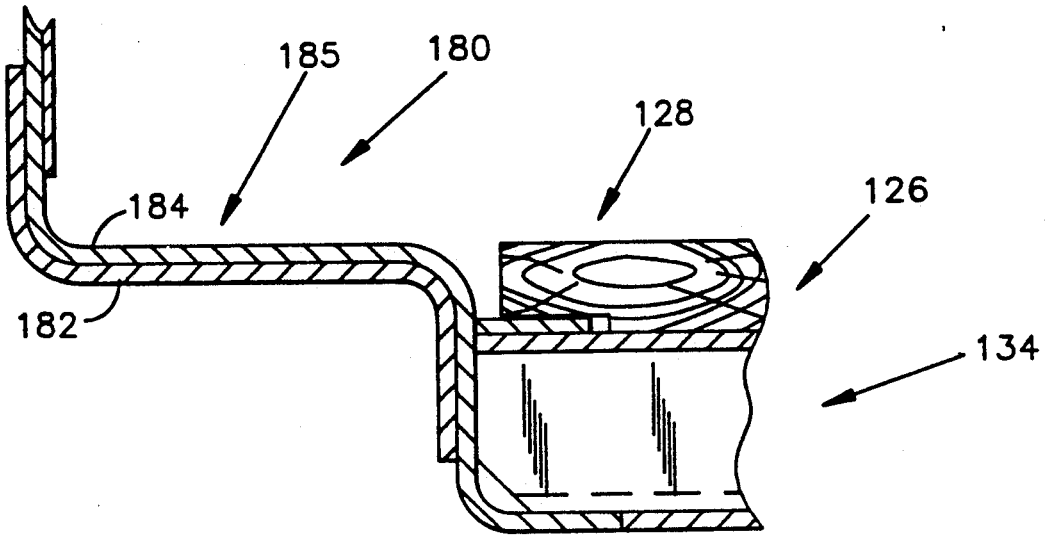
FIG. 10 is a partial cross sectional view taken along line 10—10 of FIG. 6 to show one of four bottom lift pockets that can be simultaneously engaged to lift and move the cargo container.
Figure 11:
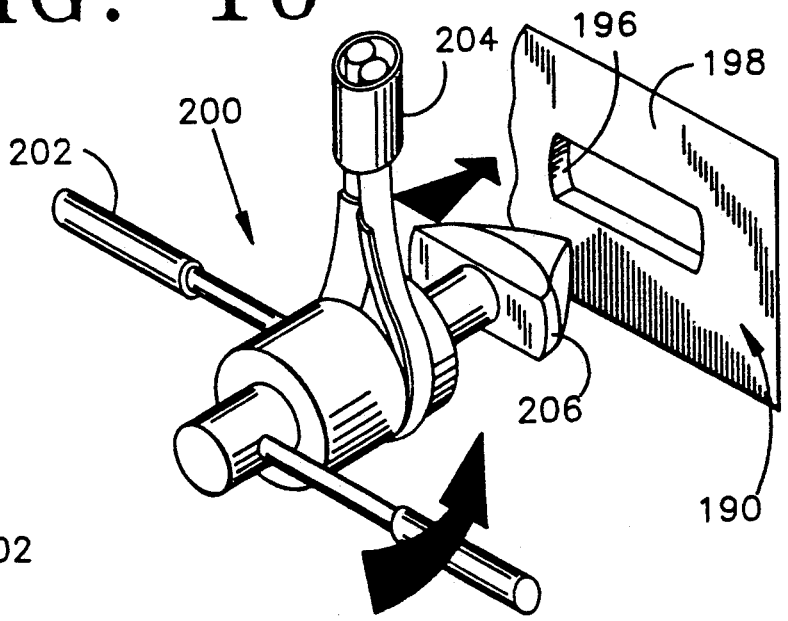
FIG. 11 is a detailed perspective view of one of four identically configured bottom lift pockets designed to allow engagement with a lift pin attached to a crane or other lifting mechanism for lifting or movement of the cargo container.

In addition to top lift pockets 170, bottom lift pockets can be used to move the cargo container 110. However, to maintain the low vertical dimensions of the floor 126, modifications to both the low profile supports 134 and floor strips 136 must be made. For example, as best illustrated in FIG. 10 and FIG. 7, the floor strips 136 in the vicinity of the bottom lift pocket 180 must be removed to accommodate a pocket plate 184 and its supporting reinforcement plate 182. This allows a substantially flat, low vertical profile floor surface to be maintained, and simplifies cargo loading or unloading.

As can be seen in FIG. 10, the floor supports 134 are connected to the pocket plate 184, rather than to a joining means 44, such as shown in FIG. 3. The pocket plate 184 is folded to provide a level surface 185 at the same level as the floor surface 128, maximizing the amount of available internal cargo space.

Figure 12:
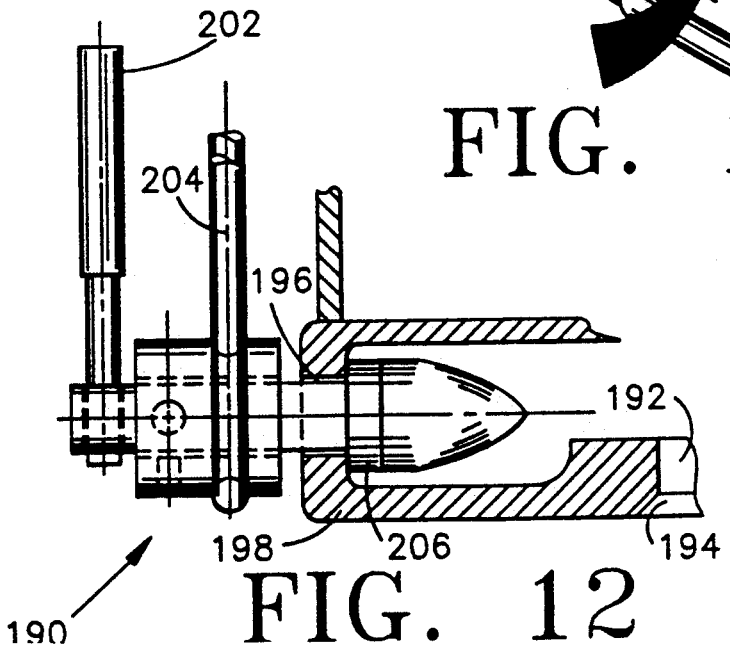
FIG. 12 is a side cross sectional view of a bottom lift pocket such as shown in FIG. 11, with a lift pin for engaging the bottom lift pocket schematically represented in an inserted position.
Figure 13:
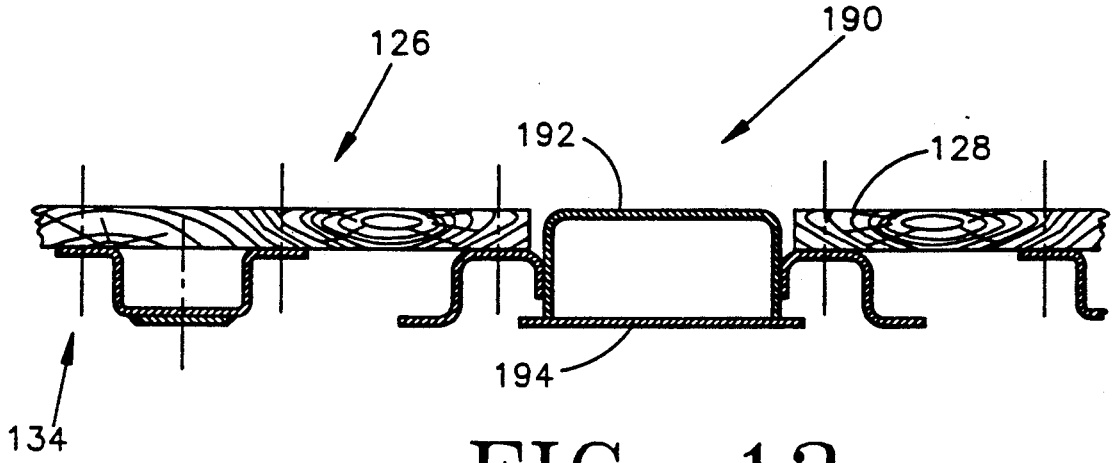
FIG. 13 is a partial cross sectional view taken along line 13—13 of FIG. 7 to show floor structure adjacent to a bottom lift pockets and directly behind the lift pin shown in FIG. 11.
Figure 14:
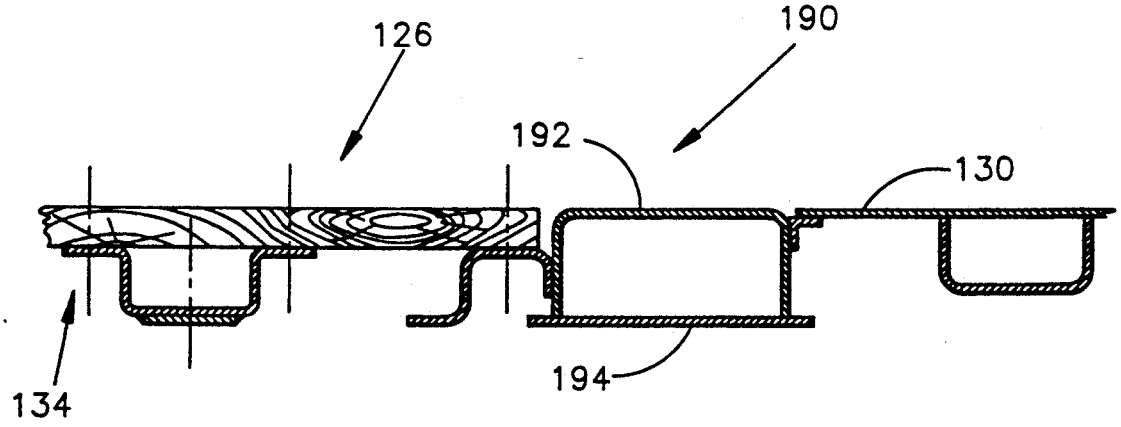
FIG. 14 is a partial cross sectional view taken along line 14—14 of FIG. 6 to show floor structure adjacent to another of the bottom lift pockets and aft of the rear fitting at the lift pin shown in FIG. 11.

Another bottom lift attachment mechanism is illustrated with reference to FIGS. 11–14, which shows a representative bottom lift pocket 190. As seen in prospective view in FIG. 11, the bottom lift pocket 190 includes an aperture plate 198 forms define an aperture 196 therethrough. A lifting mechanism 200 includes a symmetric rotatable lift pin 206, a handle 202 for manual rotation of lift pin 206, and a hoist 204 connected to a crane or other lifting mechanism. The lift pin 206 is inserted through the aperture 196 and rotated into a locking position that permits secure lifting attachment. This is best illustrated in FIG. 12, which shows the pin locked into place to allow lifting of the container 110. As was required in connection with bottom lift pocket 180, the bottom lift pocket 190 requires modifications to the floor 126 of the cargo container 110 to maintain a substantially constant vertical floor height (and consequent substantially flat floor surface) that maximizes cargo capacity. This is best illustrated by FIGS. 13 and 14 which respectively show a bottom lift pocket 190 connected between floor strips 136, and a bottom lift pocket 190 connected between floor strips 136 and a metal plate 130. The bottom lift pocket 190 can extend partially across the width of the cargo container 110 or completely across. The tunnel plate 192 is supported by a tunnel bolster 194 and is connected to the aperture plate 198. As will be appreciated by those skilled in the art, alternative positions for the bottom lift pockets are possible.

Although the invention has been described in detail with reference to the illustrated preferred embodiment, variations and modifications exist within the scope and spirit of the invention as described and as defined in the following claims.

What is claimed is:

1. An apparatus for engaging a lift element of a vertical mover, the vertical mover being configured to lift a cargo container for carrying cargo, the cargo container having a floor, a roof, a pair of parallel side walls, and first and second end walls respectively connected between the sidewalls, with at least one of the side walls and end walls defining an opening therethrough to permit entry and exit of cargo, wherein the apparatus comprises a plurality of lift pockets fixed on said pair of parallel side walls adjacent to said roof, each lift pocket having a back plate and a guide plate attached in spaced apart parallel relationship to the back plate to define a cavity therebetween, means for guiding the lift element into engagement with the lift pocket, the guiding means including configuration of the guide plate to have opposing edges defining a guide plate aperture therebetween, with the opposing edges guiding an upwardly moving lift element into engagement with the lift pocket.

2. The apparatus of claim 1 wherein said plurality of lift pockets are positioned bilaterally symmetric with respect to each other, with each lift pocket on one of the side walls being matched by a corresponding lift pocket on the other side wall.

3. The apparatus of claim 1 wherein pairs of said plurality of lift pockets are attached equivalent distances from a center of mass of the cargo container to facilitate even lifting of the cargo container.

4. The apparatus of claim 1 wherein four of said lift pockets are positioned bilaterally symmetric with respect to each other, with two lift pockets on one of the side walls being matched by two corresponding lift pockets on the other side wall.

5. The apparatus of claim 1 wherein an upper edge of the guide plate aperture defines an arcuate segment.

6. The apparatus of claim 5 wherein said upper edge defined as an arcuate segment includes a semicircular segment, said semicircular segment being configured to intersect said opposing edges of the means for guiding engagement of the lift element, the opposing edges including a pair of diverging segments spreading apart in a downward direction and defined on opposing sides of said guide plate, with said diverging segments being configured to guide said upwardly moving lift element into engagement with the lift pocket.

7. The apparatus of claim 1 wherein the guide plates of the lift pockets are integral with the side walls to lie parallel thereto.

8. The apparatus of claim 7 wherein the back plate is divided into a first portion arranged parallel to the guide plate, and a second portion ramped at a dihedral angle relative the guide plate to rampingly guide the lift element into the cavity defined between the guide plate and the back plate.

9. An cargo container assembly liftable by a lift element of a vertical mover, the cargo container assembly comprising a floor, a roof arranged in spaced apart parallel relationship above the floor, a pair of parallel side walls connecting the roof and the floor, first and second end walls respectively connected between the sidewalls, and a plurality of lift pockets fixed to said pair of parallel side walls, each lift pocket having a back plate positioned between the pair of sidewalls and attached to one of the sidewalls, and a guide plate attached lie in parallel contiguous relationship to the side wall in spaced apart parallel relationship to the back plate to define a cavity therebetween, with the guide plate configured to define a guide plate aperture therethrough to allow acceptance of the lift element.

10. The apparatus of claim 9 wherein opposing edges surrounding said guide plate aperture are configured to define diverging segments to guide the lift element into engagement with the lift pocket, with the opposing edges being configured to downwardly diverge.

11. The apparatus of claim 10 wherein a semicircular segment defines an upper edge of the guide plate aperture, said semicircular edge being configured to intersect said diverging segments, and with said diverging segments guiding the upwardly moving lift element into engagement with said semicircular upper edge of the guide plate aperture of the lift pocket.

12. The apparatus of claim 9 further comprising means for rampingly guiding a lift element into the cavity, said means comprising division of the back plate into a first portion arranged parallel to the guide plate, and a second portion angled relative to the guide plate to rampingly guide the lift element into the cavity defined between the guide plate and the back plate.

13. The apparatus of claim 9 wherein the floor is supported by a plurality of low profile floor supports extending between the side walls to increase container capacity without increasing exterior dimensions of the container.

14. The apparatus of claim 9 wherein said low profile floor supports are attached to support a plurality of floor strips collectively defining a floor surface capable of supporting cargo.

15. The apparatus of claim 14 wherein each floor support forms in cross section a U-shape.

* * * * *